US012043991B2

(12) United States Patent
Mazzei

(10) Patent No.: US 12,043,991 B2
(45) Date of Patent: Jul. 23, 2024

(54) ANTI-WASTE SANITARY SYSTEM

(71) Applicants: Marco Mazzei, Rome (IT); Sara Basso, Rome (IT)

(72) Inventor: Romualdo Mazzei, Rome (IT)

( * ) Notice: Subject to any disclaimer, the term of this patent is extended or adjusted under 35 U.S.C. 154(b) by 506 days.

(21) Appl. No.: 17/298,542

(22) PCT Filed: Dec. 14, 2019

(86) PCT No.: PCT/IB2019/060773

§ 371 (c)(1),
(2) Date: May 29, 2021

(87) PCT Pub. No.: WO2020/121275

PCT Pub. Date: Jun. 18, 2020

(65) Prior Publication Data

US 2022/0018100 A1 Jan. 20, 2022

(30) Foreign Application Priority Data

Dec. 14, 2018 (IT) ..... 102018000011133

(51) Int. Cl.
*A47K 3/40* (2006.01)
*E03B 1/04* (2006.01)

(52) U.S. Cl.
CPC ..... *E03B 1/041* (2013.01); *A47K 3/40* (2013.01); *E03B 2001/045* (2013.01)

(58) Field of Classification Search
CPC ..... E03B 1/041; E03B 2001/045; A47K 3/40
USPC ..... 4/613
See application file for complete search history.

(56) References Cited

U.S. PATENT DOCUMENTS 3,112,497 A * 12/1963 Call ..... E03F 5/18 4/415
3,318,449 A * 5/1967 Jennings ..... E03B 1/04 210/127
2011/0067769 A1* 3/2011 Stimpson ..... E03D 5/003 137/565.01
2019/0275449 A1* 9/2019 Oscarson ..... B01D 27/146

FOREIGN PATENT DOCUMENTS

CN 102535590 A 7/2012
DE 10033479 A1 1/2002
DE 202011103428 U1 11/2011

* cited by examiner

*Primary Examiner* — Huyen D Le
(74) *Attorney, Agent, or Firm* — Jose Cherson Weissbrot

(57) ABSTRACT

This invention is part of the domestic systems that help to make the use of water that is commonly used via various utilities, more economical and ecological. In particular, the invention relates to a system suitable for being inserted in the bathroom to avoid wasting water.

7 Claims, 1 Drawing Sheet

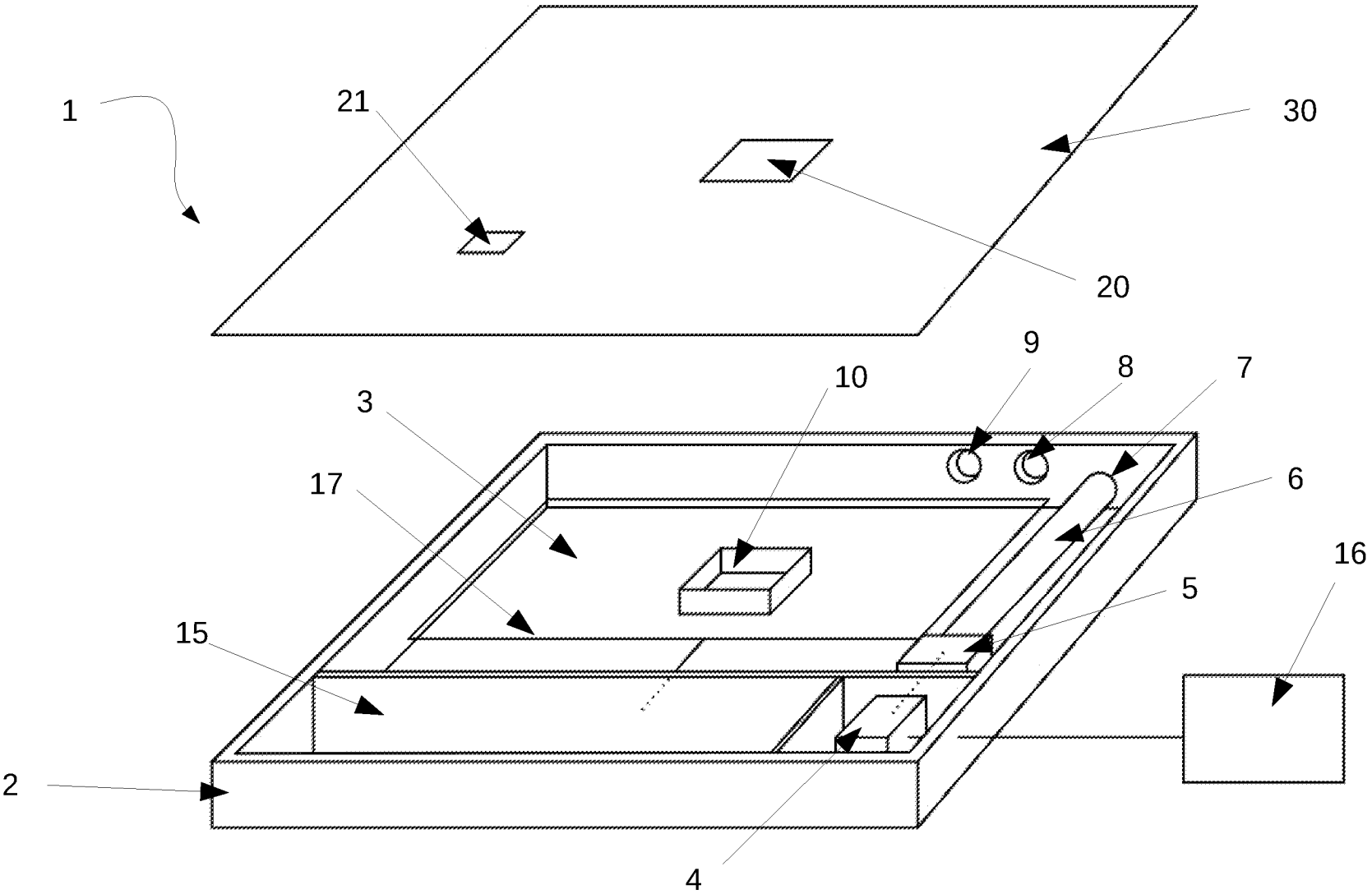
30
20
21
1
16
6
7
8
9
10
5
4
3
17
15
2

ANTI-WASTE SANITARY SYSTEM

FIELD OF THE INVENTION

This invention is part of the domestic systems that help to make the use of the water that is commonly used through various utilities more economical and ecological. In particular, the invention relates to a device suitable for being inserted in the bathroom.

STATE OF THE ART

Here it is necessary to make a simple observation concerning the use of drinking water.

In every home, the occupants use frequent large amounts of water throughout the day: for the kitchen, for electrical appliances and for the bathroom. Except for rare cases, all the water consumed inevitably ends up in the sewers, without any kind of distinction. It should be noted that, depending on the uses to be made of it, it would not always be necessary to have drinking water available: the most important case is that of the water used for a WC. The water that is used for the flushing function in the toilet does not necessarily need to be potable or treated water. Indeed, considering that throughout the day an individual uses the toilet several times, one can immediately understand how much drinking water is actually wasted; statistics to hand, it is just as easy to understand how more than 50% of the quantity of domestic water used in a day is lost in just using the WC, as its function requires the use of 5/7 liters of water every single time. What is more, this water, in addition to having a cost, is totally unused with regard to its most important characteristic, i.e. being potable.

In addition to this, water resources are becoming more and more deficient by the day, partly due to the enormous use that is made of them.

Therefore, having concluded the necessary introduction, this invention offers an innovative anti-waste sanitary system that is capable of performing important water saving functions.

It should be noted that in prior art there are already proposals in this sense, but most of the systems offered are very complex and, therefore, less attractive to the user who requires simple systems, that are preferably cheap and easy to maintain, as offered by the purposes of this invention.

In particular, US patent 79 27 481B1 describes a device comprising a settling tank equipped with an inlet, which is connected to a washing water drain point. An overflow dividing partition is provided for separating the settling tank and a collection tank. An electric float unit connects to a pump and a fill valve. The electric float unit is controlled by a float unit in the collection tank to close a pump power supply and to open the valve power supply for the input flow to fill. Basically, there is a device that collects waste water from a sink or shower and then lets this collected water settle in a tank so that the major impurities sink to the bottom, the recycled water used subsequently is that which remains on the surface and passes into the collection tank.

Although certainly intelligent, this solution does not take into account the time needed for the heavy dirt to "decant to the bottom", so that, unfortunately, if this settling time has not elapsed, the recycled water cannot be supplied. Nothing is said about the time required for this to happen, so there is no certainty provided. Furthermore, the collection tank, acting as a tank where "dirty" water is collected, will certainly allow germs and bacteria to proliferate as, instead of being immediately swept away by the flow of water, they will remain there and have a damaging effect on the hygiene of the entire system, as well as the bathroom or similar. In fact, when the so-called "purified" water passes from the settling tank 1 into the collection tank 2, this water will have passed through tank 1 which is actually a dirt collector, therefore, it is likely that in the long run instead of being cleaner, the water overflow in tank 2 is indeed richer in germs and bacteria. Although there is a plug for emptying the heavy dirt in the tank 1, when it is opened on command by the special float, the dirt that may have become encrusted on the bottom of the tank 1 is not expelled.

One purpose of this invention is to describe a water recycling system, i.e. an anti-waste system, that makes it possible to maintain the correct hygiene of all the parts and secondary devices to which said water is supplied.

Another purpose of this invention is to describe an anti-waste system that is also hygienic in all the essential parts of the system.

It is a purpose of this invention to describe an anti-waste sanitary system that reduces the consumption of drinking water.

Furthermore, it is a purpose of this invention to describe an innovative anti-waste sanitary system that saves energy.

It is a further purpose of this invention to describe an anti-waste sanitary system that can contribute to the reduction of water costs.

Another purpose of this invention is to describe an anti-waste sanitary system that can be adapted or mounted in any bathroom without any specific further structural adjustments.

Another purpose of this invention is to describe an anti-waste sanitary system that is simple to install and convenient in price.

BRIEF DESCRIPTION OF THE INVENTION

These and further purposes will be achieved thanks to the innovative anti-waste sanitary system comprising at least one container body comprising at least one tank for waste water and comprising pipes/means for connecting to drains preferably of sanitary fixtures, it further comprises at least one pump connected to said tank and further connections between said tank and at least one secondary device suitable for receiving and using waste water, said pump being able to send the water collected in said tank to at least one secondary device, said system being positioned under at least one sanitary fixture such as at least one shower plate/tray for receiving the waste water, characterized by the fact that said system comprises at least one container for antibacterial and/or disinfectant and/or perfumed substances etc. that are delivered by a self-cleaning tube exiting from said container, being positioned in said tank, said tube being equipped with nozzles directed towards said tank that are suitable for dispensing said substances in said tank for the occasional cleaning and sanitation thereof.

In a particularly advantageous way, said anti-waste sanitary system can be integrated with a shower tray directly during its production.

In a further advantageous way, said anti-waste sanitary system in one feasible variant is integrated with a shower tray/plate during its assembly, thus being a separate element but which can be integrated with at least one shower plate or tray or other elements or devices suitable for that purpose.

In particular, said at least one secondary device suitable for receiving "recycled" wastewater is, for example, a WC.

The anti-waste sanitary system that is the subject of this invention, as stated, comprises a container body to be positioned under a shower tray or already forming part of a shower tray, in a further advantageous manner, said container body further comprises at least one compartment in which a motor, for example electric, is housed and suitable for operating said pump for liquids housed for example in said tank (i.e. being an immersion pump), where said pump sucks the water collected in said collection tank. Note that in some embodiments the pump can also be positioned elsewhere in the container body and not be an immersion pump, i.e. it can be a common suction pump, the immersion pump variant being particularly advantageous to occupy the least possible space, thus reducing the overall dimensions.

In further embodiments, the actuation motor of said pump can be integrated with the pump itself.

Said collection tank therefore comprises at least one inlet from which at least the water drain of one or more sanitary fixtures (for example a washbasin) comes, furthermore, said tank comprises a drain outlet connected to a sewer and a further outlet connected to a direct pipe, as stated, to at least one secondary device. One delivery of said pump is connected to the inlet of the pipe directed towards the secondary device, for example a WC.

The collection tank can further comprise at least one siphoned tray suitable to act as a siphon for draining water from an overlying shower tray, said shower tray drained water can also be collected in said tank.

BRIEF DESCRIPTION OF THE DRAWINGS

These and further advantages obtained thanks to the innovative anti-waste sanitary system described by this invention will be further clarified and examined thanks to the description of the attached drawings in which:

FIG. 1 shows an overall view of the anti-waste sanitary system that is the subject of this invention.

DESCRIPTION OF THE DRAWINGS

It should be noted that this description has a mere explanatory and non-limiting purpose, so other embodiments of the system and of the related components are to be considered the subject of this invention.

FIG. 1 The drawing shows a particularly preferred embodiment of the anti-waste sanitary system 1 that is the subject of this invention. The container body 2, for example made in resin, has a shape suitable for being inserted under a shower tray of any size, material or shape, said container can in fact be made in various shapes and sizes suited to meet the requirements of being inserted under a shower tray.

Inside the container 2 the wastewater coming (in this example) from a shower—inlet 20 on shower plate 30—and from a washbasin—inlet 9 in the tank—, (shower and washbasin not visible here) are collected in a collection tank 3.

The water coming from the sink is collected by means of said inlet 9 while the water coming from the shower through an inlet 20 and/or by means of a siphon tray 10 which will overflow into the collection tank 3.

A liquid pump 5 installed for example inside the collection tank 3, driven for example by a motor 4 installed for example in a compartment 11, will suck the water collected in the tank 3 and by means of a delivery pipe 6 and of an outlet 7 will send said collected water to a secondary device, for example a WC, a western toilet or urinal or the like, to be used a second time and therefore perform a completely advantageous flush with water that would be otherwise lost directly in the drains without the possibility of further use, therefore to the full advantage of energy saving and respect for the environment.

The container body 2 also comprises an outlet 8 (pipe or the like) towards the sewer, which will be used in the event that the collection tank 3 is no longer able to contain water, or is at the containment limit, whereby said outlet acts as a sort of "overflow" system and safety system.

In a variant there may also be at least one self-cleaning tube 17 equipped for example with nozzles, located inside said tank 3, said tube starts from at least one container 15 containing, for example, antibacterial substances and/or disinfectants in general and/or perfumed substances (or being simultaneously antibacterial and disinfectant and perfumed, bleaching agents etc.), said tube 17 being connected in turn to the pump 5 and its nozzles being directed into the tank 3 for occasional cleaning and sanitizing of the same for the benefit of cleaning the system of the secondary devices and the general reduction of bacteria and dirt in the system and the environment, in a completely advantageous way compared to the prior art mentioned where complete cleaning of the anti-waste system, secondary devices and drains all-round is not covered.

Furthermore, as above, said water mixed with product dispensed from the container 15 can be dispensed into the secondary device, being further useful for cleaning that too, or in the case of an "overflow", going to the outlet 8 towards the sewer and cleaning this outlet.

Therefore, also said water mixed with product can be used to be sent for rinsing secondary devices, e.g. a WC, and for disinfection of the tank 3 and for general cleaning of all the pipes in the system 1, for full cleaning of the anti-waste system, drains and secondary devices.

Said substances can be refilled as needed by suitable means, the tray will for example comprise a cap 21 via which these substances can be refilled, this being not influential for the protection scope of this invention.

In the place that is deemed most appropriate, not necessarily in the wall behind the WC, a small display, i.e. a control unit 16, can be positioned, from where it is possible to control and operate the pump for draining the recycled water. For example, it will be possible to customize the starting time (duration of recycling water emission). Furthermore, it will be possible to customize the time and day both for the supply of water in the secondary device (for example, to prevent the flush from drying out if said device remains unused for a long time, to avoid unpleasant smell) and/or for self-cleaning the tank 3, of course, any type of function useful for this anti-waste sanitary system can be present and inserted. In a further advantageous way, for the benefit of the environment, by dispensing recycled water from the shower and/or sink to the WC or the like, said water will almost certainly include dissolved soaps and detergents, therefore when dispensing said recycled water into the secondary device, it will also clean it at the same time, thus avoiding the daily use of additional products for sanitizing the WC, which are usually pollutants and expensive products.

Therefore, while the shower or sink or the like are being used the wastewater will not end up directly in the sewer but will be advantageously collected by said anti-waste sanitary system. As stated, it can be positioned after market under the shower tray or integrated with the shower tray.

The user who will use the WC, or similar secondary device, therefore, by operating the pump 5 will activate a flow of water from the collection tank 3 to the WC itself, thus carrying out a completely ecological and economic flush as only recycled water is being used.

It can be noted that, thanks to this invention, all the said purposes have been achieved and that, in a completely advantageous way, said invention can be used in every home with great advantage for the environment and for saving water, a problem which is widely felt around the world.

Variants in materials used for the construction of the system, shapes of the individual components of the system, type of connections to sanitary fixtures, number of connections with sanitary fixtures, presence or absence of filters, number of tanks, types of cleaning systems, any further positioning etc. are to be considered included in the scope of this invention and are therefore to be considered mere feasible variants thereof and therefore protected by the invention as better clarified by the appended claims.

What is claimed is:

1. An anti-waste sanitary system (1) comprising container body (2), the container body (2) comprising:

a collection tank (3) for holding waste water; the collection tank (3) having a front portion and a rear portion;

an inlet (9) positioned at the rear portion of the collection tank (3), the inlet (9) is configured to collect the waste water from a sink:

a first outlet (8) positioned at the rear portion of the collection tank (3) adjacent to the inlet (9), the first outlet (8) is connected to drain of sanitary fixtures configured to flow the waste water from the collection tank (3);

a pump (5) installed inside the collection tank (3), the pump (5) having a front side and a rear side;

a motor (4) drives the pump (5). the motor (4) is connected to the front side of the pump (5) configured to suck the waste water collected in the collection tank (3);

a delivery pine (6) with a second outlet (7) connected to the rear side of the pump (5), the delivery pipe (6) sends the waste water sucked by the motor (4) to a secondary device;

a container (15) installed completely inside the collection tank (3), the container (15) positioned at the front portion of the collection tank (3), and the container (15) contains an antibacterial and/or disinfectant and/or perfumed substances;

a self-cleaning tube (17) exiting from the container (15), the self-cleaning tube (17) being positioned in the collection tank (3), the self-cleaning tube is directed towards the collection tank (3) to dispense the antibacterial and/or disinfectant and/or perfumed substances towards the collection tank (3).

2. The anti-waste sanitary system (1) according to claim 1, wherein said system is integrated with a shower tray (30) directly during production thereof.

3. The anti-waste sanitary system (1) according to claim 1, wherein said system is integrated with a shower tray/plate during assembly thereof, thus being a separate element that can be integrated post-production.

4. The anti-waste sanitary system (1), according to claim 1, wherein the secondary device is suitable for receiving "recycled" wastewater is a WC.

5. The anti-waste sanitary system (1) according to claim 1, wherein the outlet (8) is used in the event that the collection tank (3) is no longer able to contain water.

6. The anti-waste sanitary system (1) according to claim 1, wherein sanitizing products introduced into said collection tank (3) are also used for the disinfection of the secondary devices for cleaning the outlet (8) for full cleaning of the anti-waste system, drains and secondary devices.

7. The anti-waste sanitary system (1) according to claim 1, wherein said system comprises a programming control unit (16), from where the pump (5) for the discharge of recycled water is controlled and operated, said control unit being customizable at least for the time it is switched on (duration of recycled water emission), and/or the time and day both for the supply of water in the secondary device and for the self-cleaning of the collection tank (3).

* * * * *